US006941842B1

(12) United States Patent
Liou

(10) Patent No.: US 6,941,842 B1
(45) Date of Patent: Sep. 13, 2005

(54) WRENCH COMBINATION

(76) Inventor: Mou-Tang Liou, No. 25,Lane 86,Ta Wei Rd., Ta Li City,Taichung Hsien (TW)

( * ) Notice: Subject to any disclaimer, the term of this patent is extended or adjusted under 35 U.S.C. 154(b) by 0 days.

(21) Appl. No.: 10/854,089

(22) Filed: May 25, 2004

(51) Int. Cl.[7] ..... B25B 13/00
(52) U.S. Cl. ..... 81/124.5; 81/124.4; 81/177.6; 403/85
(58) Field of Search ..... 81/124.5, 124.4, 81/177.6, 177.85; 403/85

(56) References Cited

U.S. PATENT DOCUMENTS 3,587,366 A * 6/1971 Klen ..... 81/124.5
3,742,790 A * 7/1973 Galley ..... 81/124.5
5,896,791 A * 4/1999 Oberdorf ..... 81/124.4
6,257,103 B1 * 7/2001 Yu ..... 81/177.6
6,692,178 B2 * 2/2004 Yu ..... 403/85

* cited by examiner

*Primary Examiner*—Joseph J. Hail, III
*Assistant Examiner*—Alvin J. Grant
(74) *Attorney, Agent, or Firm*—Charles E. Baxley

(57) ABSTRACT

A wrench combination includes a first wrench and a second wrench. The first wrench includes a shaft and two sockets each formed at an end of the shaft. The second wrench is rotationally connected with the first wrench. The second wrench includes a shaft and two sockets each formed at an end of the shaft.

18 Claims, 13 Drawing Sheets

WRENCH COMBINATION

FIELD OF INVENTION

The present invention relates to a wrench combination.

BACKGROUND OF INVENTION

Referring to FIG. 13, a conventional wrench combination includes a first wrench 110, a second wrench 120, a connecting element 130, a direction switch 160 and a direction controller 150. The first wrench 110 includes a circular space 113 defined therein and two grooves 114 defined in the wall of the circular space 113. The second wrench 120 includes a circular space 123 defined therein and two grooves 231 defined in the wall of the circular space 123. The connecting element 130 includes a head 132 and a shaft 131 extending from the head 132. A direction switch 160 includes a disc 161 and two pillars 164 extending from the disc 161. A direction controller 150 includes an aperture 51 defined therein and two ridges 152 formed on a periphery thereof. In assembly, the connecting element 130 is driven into a nut 140 through the circular space 113, the aperture 151 and the circular space 123. Thus, the first wrench 110 is firmly attached to the second wrench 120. When a user pushes down the direction switch 160, the pillars 162 pushing the ridges 152 into the grooves 231 so that the direction controller 150 disengaging from the first wrench 110 so as to keep the first wrench 110 and the second wrench 120 in a rotational mode. When the direction switch 160 is upwardly moved by means of a spring 153, the ridges 152 are moved to the grooves 114 so as to keep the first wrench 110 and the second wrench 120 in a locked mode.

SUMMARY OF INVENTION

The primary objective of the present invention is to provide a wrench combination.

A wrench combination includes a first wrench and a second wrench. The first wrench includes a shaft and two sockets each formed at an end of the shaft. The second wrench is rotationally connected with the first wrench. The second wrench includes a shaft and two sockets each formed at an end of the shaft.

Other objects, advantages, and novel features of the invention will become more apparent from the following detailed description when taken in conjunction with the attached drawings.

BRIEF DESCRIPTION OF DRAWINGS

The present invention will be described through detailed illustration of three embodiments referring to the drawings.

DETAILED DESCRIPTION OF EMBODIMENTS

Figure 1:
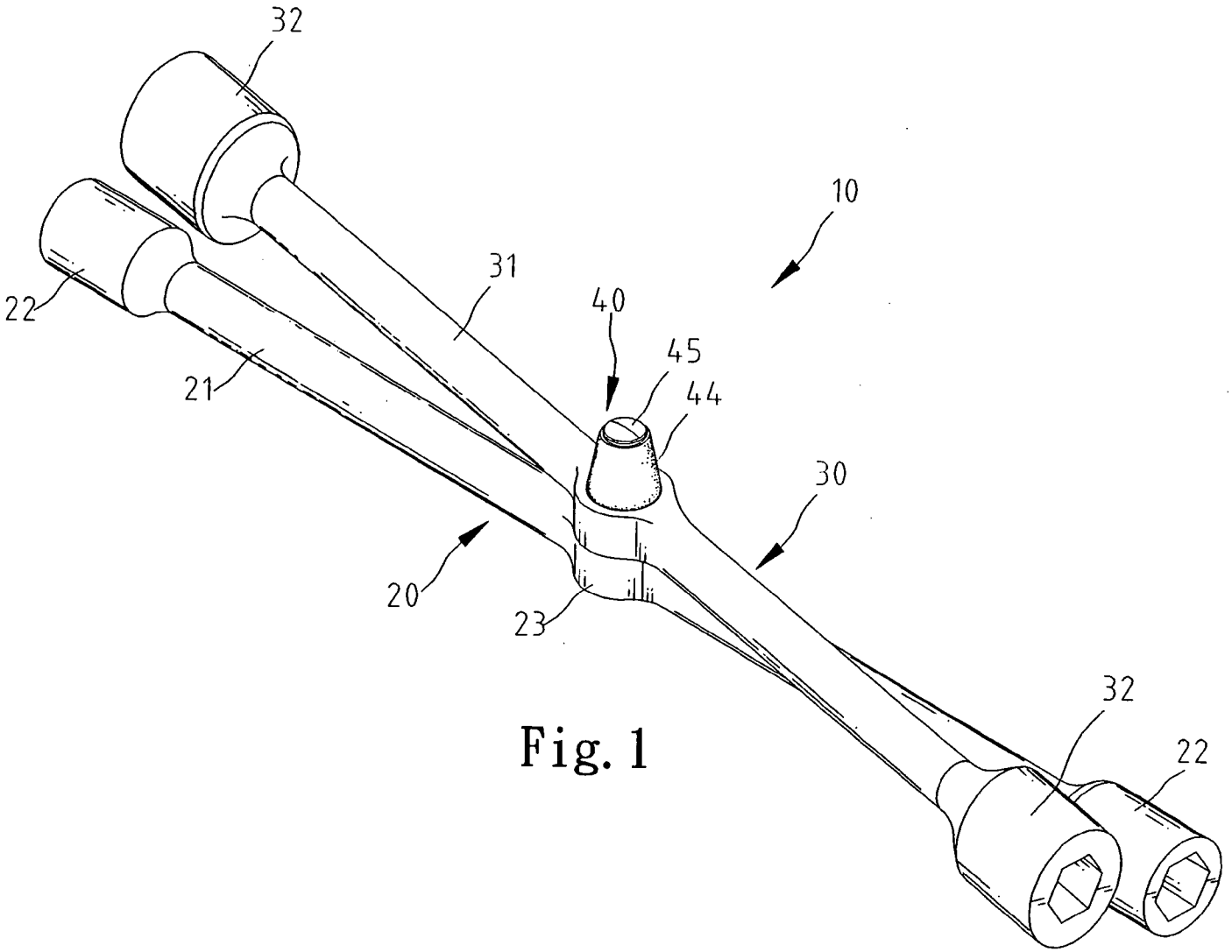
FIG. 1 is a perspective view of a wrench combination according to a first embodiment of the present invention.
Figure 2:
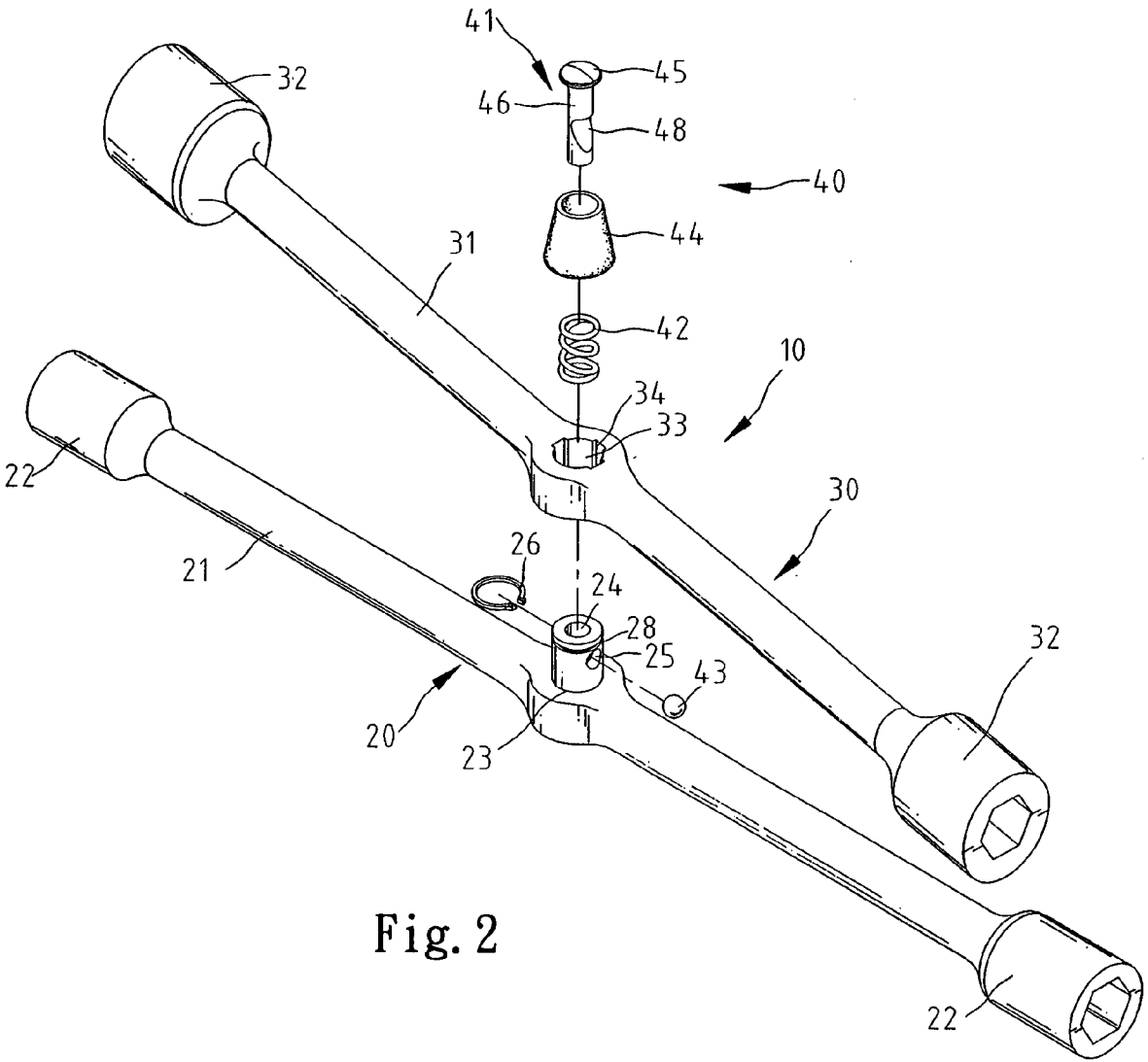
FIG. 2 is an exploded view of the wrench combination of FIG. 1.

Referring to FIGS. 1 and 2, according to a first embodiment of the present invention, a wrench combination 10 includes a first wrench 20, a second wrench 30 and a control device 40. The first wrench 20 includes a shaft 21 and two sockets 22 each formed at an end of the shaft 21. The first wrench 20 includes a tube 23 formed at a center of the shaft 21. The tube 23 includes a bore 24, an aperture 25 communicated with the bore 24 and an annular groove 28 defined in a periphery thereof.

The second wrench 30 includes a shaft 31 and two sockets 32 each formed at an end of the shaft 31. The shaft 31 includes a bore 33 defined in a center thereof. The bore 33 includes three grooves 34 defined in the wall thereof. The bore 33 is used for receiving the tube 23.

The control device 40 includes a control element 41, a spring 42, a ball detent 43 and a cap 44. The control element 41 is put in the tube 23. The control element 41 includes a head 45, a rod 46 extending from the head 45 and a recess 48 defined in the rod 46. The spring 42 is compressed between the head 45 and the tube 23. Thus, the control element 41 is biased upwardly by means of the spring 42. A portion of the ball detent 43 is trapped in the aperture 25. The remaining portion of the ball detent 43 is caused to extend from the recess 48. Therefore, the ball detent 43 can retain the first wrench 20 in position relative to the second wrench 30.

When a user pushes down the control element 41, the ball detent 43 is inserted into the recess 48, i.e., the ball detent 43 is free from the grooves 34. Thus, the first wrench 20 is not locked to the second wrench 30 so that the second wrench 30 can be moved a desired angle with respect to the first wrench 20.

The cap 44 is put outside of the control element 41 and the spring 42. The cap 44 can prevent the dust or oil sludge from entering the wrench combination 10.

A C-ring 26 includes an internal edge put in the annular groove 24 so that the second wrench 30 is firmly attached to the first wrench 20.

Figure 3:
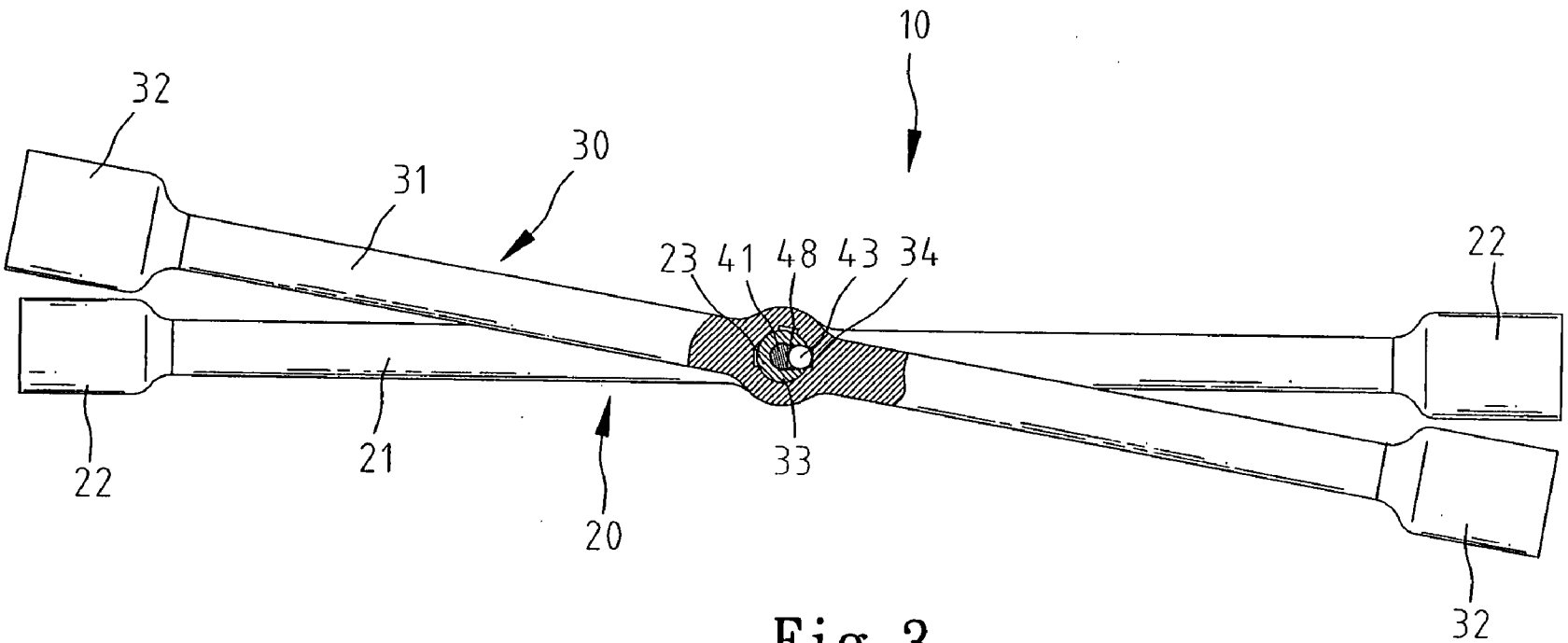
FIG. 3 is a partially cross-sectional view of the wrench combination of FIG. 1 and shows two wrenches in a locked mode.

Referring to FIG. 3, the wrench combination 10 is closed. The ball detent 43 is inserted into one of the grooves 34. Therefore, the ball detent 43 retains the first wrench 20 in position relative to the second wrench 30.

Figure 4:
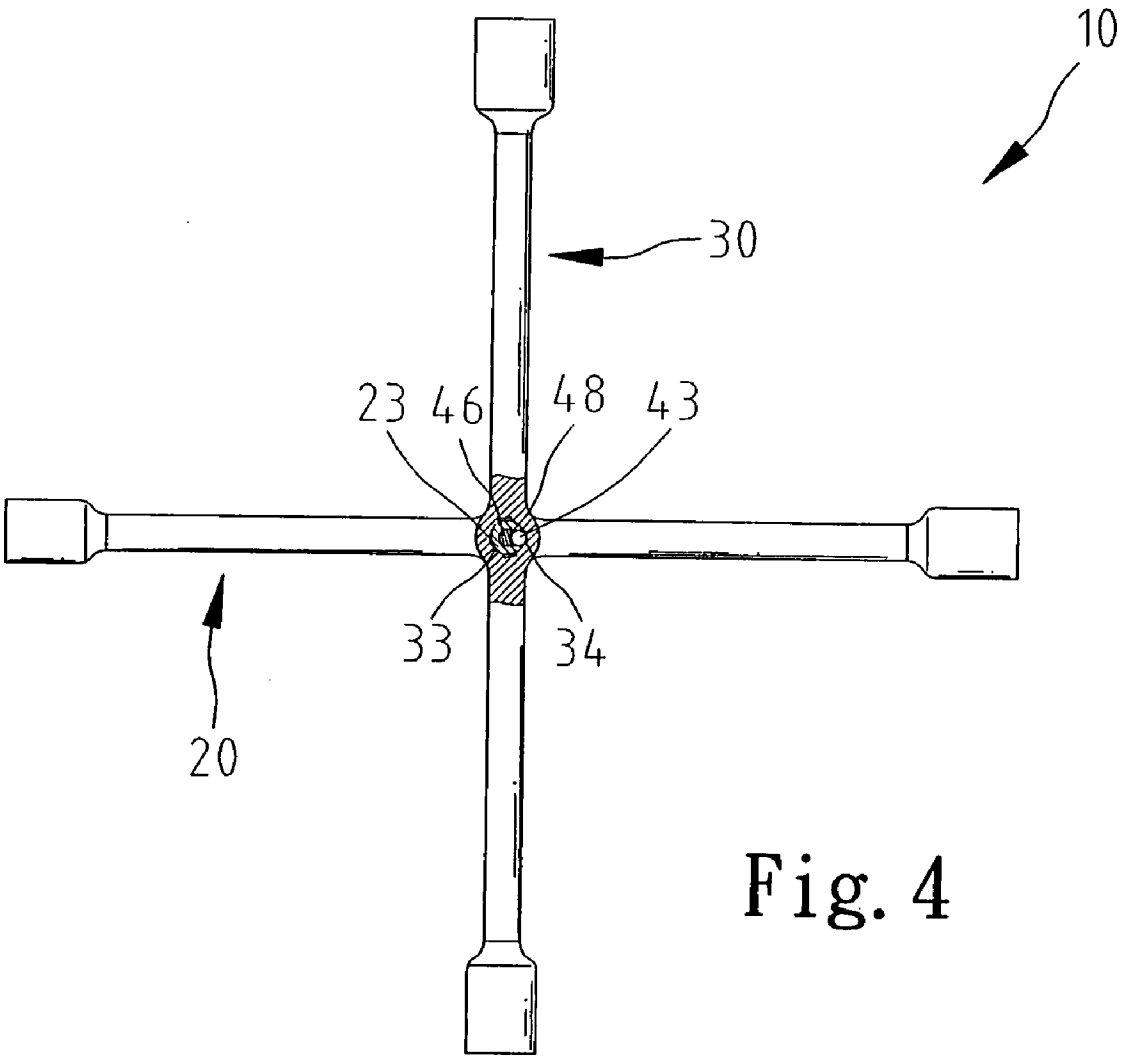
FIG. 4 is similar to FIG. 3 but shows the wrenches in a intersectional position

FIG. 4 is similar to FIG. 3 but shows the first wrench 20 and the second wrench 30 at an intersectional position. The ball detent 43 is inserted into another one of the grooves 34.

Figure 5:
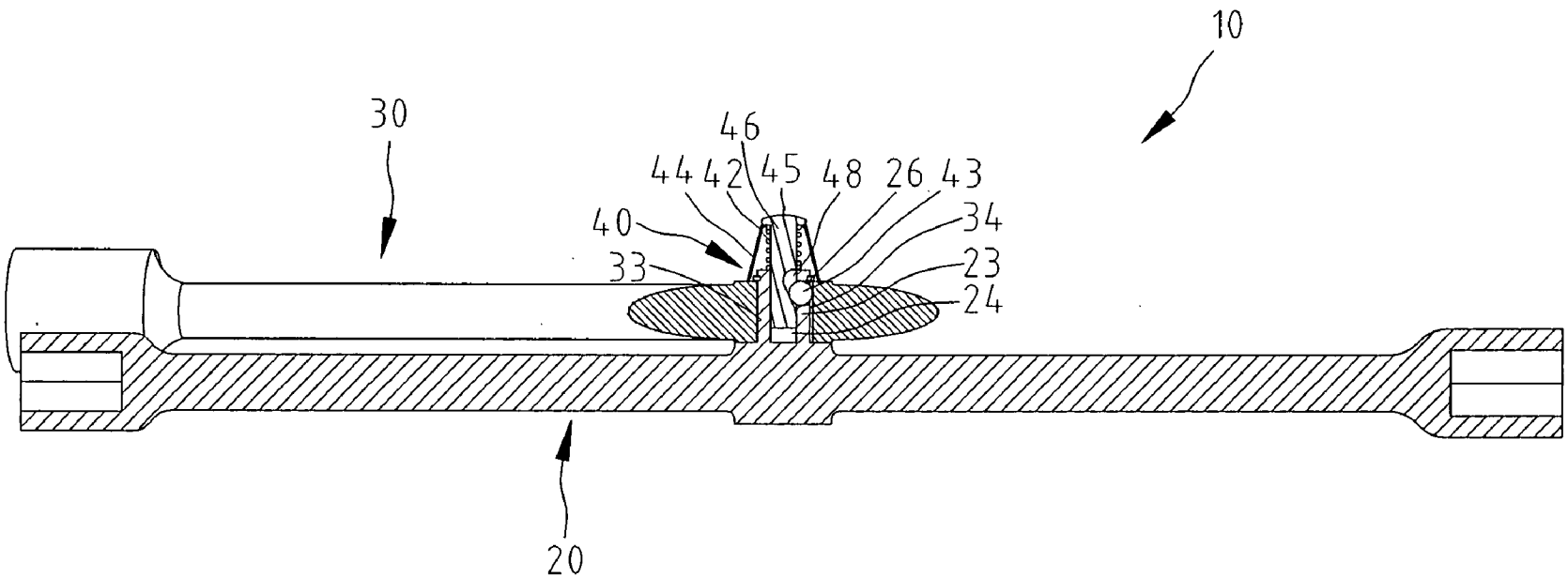
FIG. 5 is a cross-sectional view of the wrench combination and shows the wrenches in a locked mode.

FIG. 5 is similar to FIG. 3 but shows the first wrench 20 and the second wrench 30 in a locked mode. The ball detent 43 is caused to extend into one of the grooves 34 from the recess 48. Thus, the first wrench 20 cannot be rotated with respect to the second wrench 30 so as to keep the first wrench 20 and the second wrench 30 in a locked mode.

Figure 6:
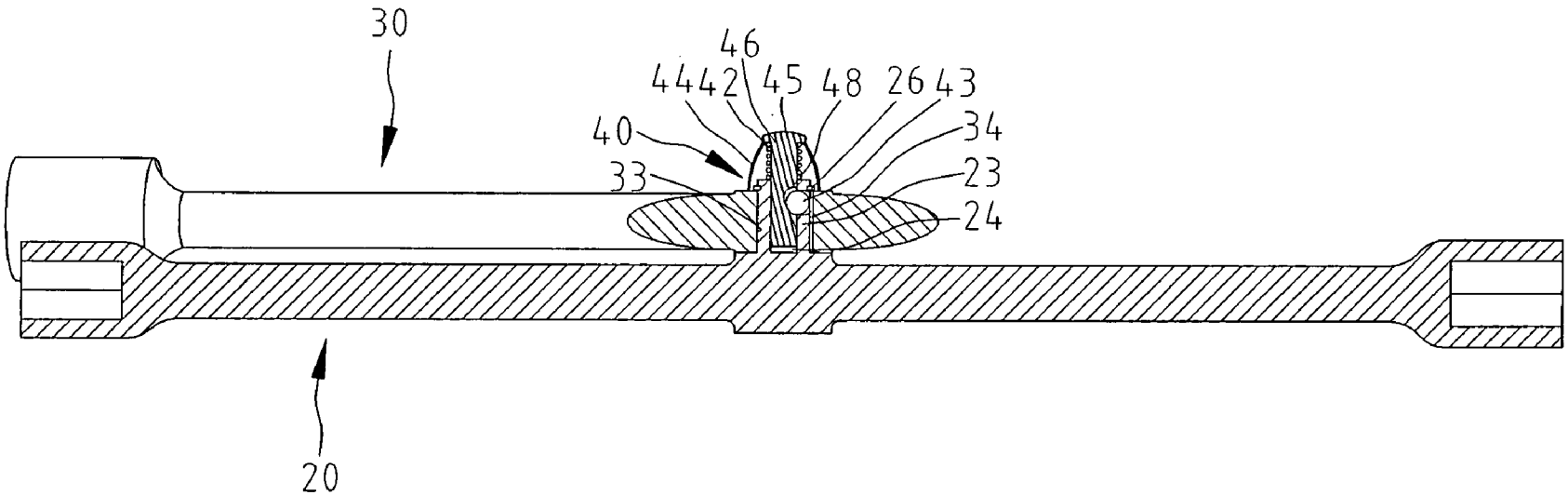
FIG. 6 is similar to FIG. 5 but shows the wrenches in a rotational mode.

FIG. 6 is similar to FIG. 5 but shows the first wrench 20 and the second wrench 30 in a rotational mode. The ball detent 43 is inserted into the recess, i.e., the ball detent 43 is free from the grooves 34. Thus, the first wrench 20 is not locked to the second wrench 30 so as to keep the first wrench 20 and the second wrench 30 in a rotational mode.

Figure 7:
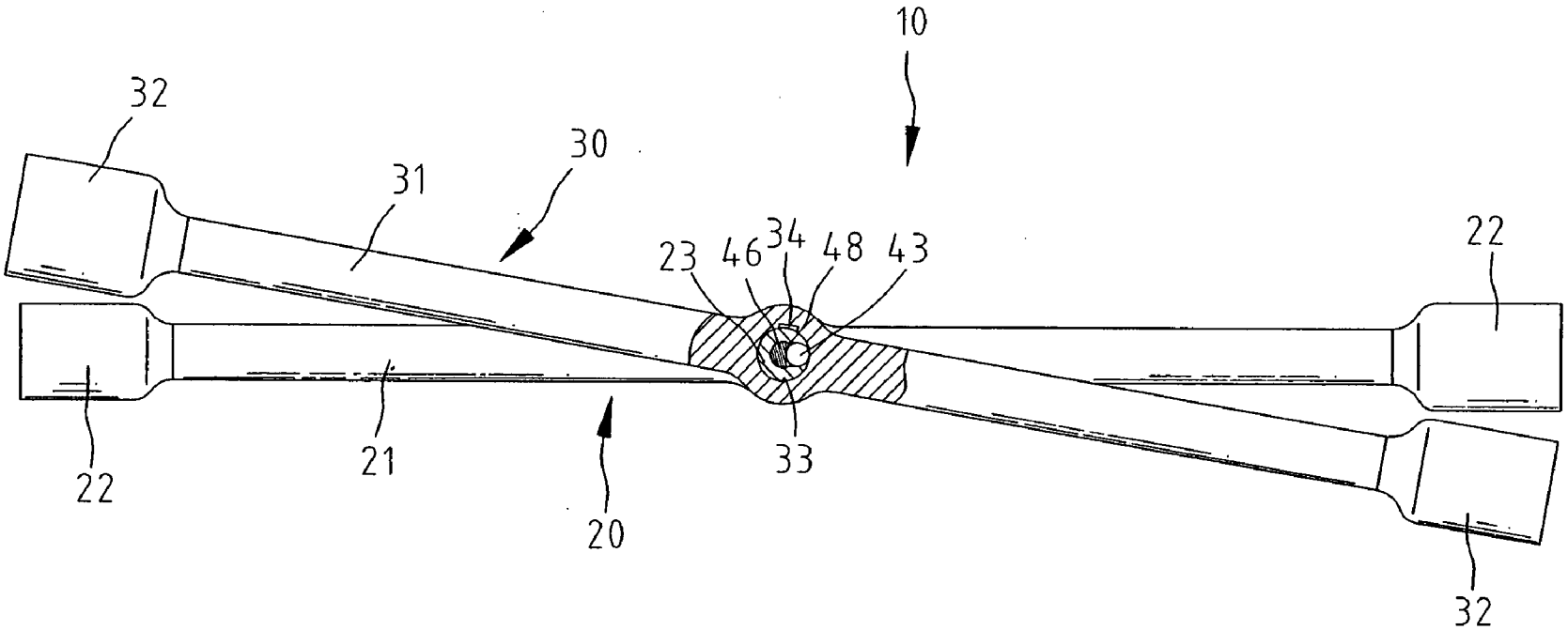
FIG. 7 is a partially cross-sectional view of the wrench combination according to a second embodiment of the present invention.

FIG. 7 shows a wrench combination 10 according to a second embodiment of the present invention. The second embodiment is identical to the first embodiment except for replacing three grooves 34 with one groove 34.

Figure 8:
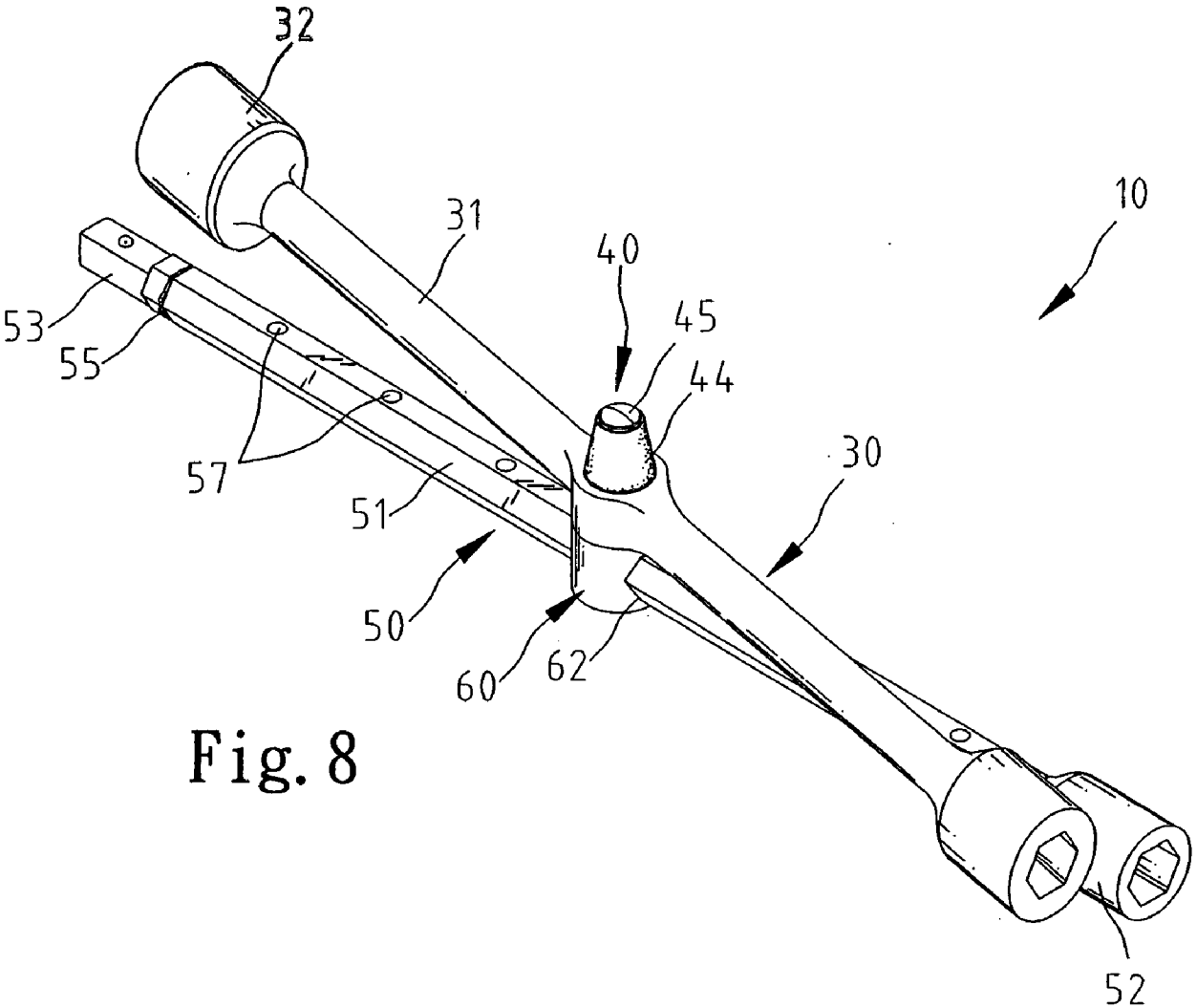
FIG. 8 is a perspective view of a wrench combination according to a third embodiment of the present invention.
Figure 9:
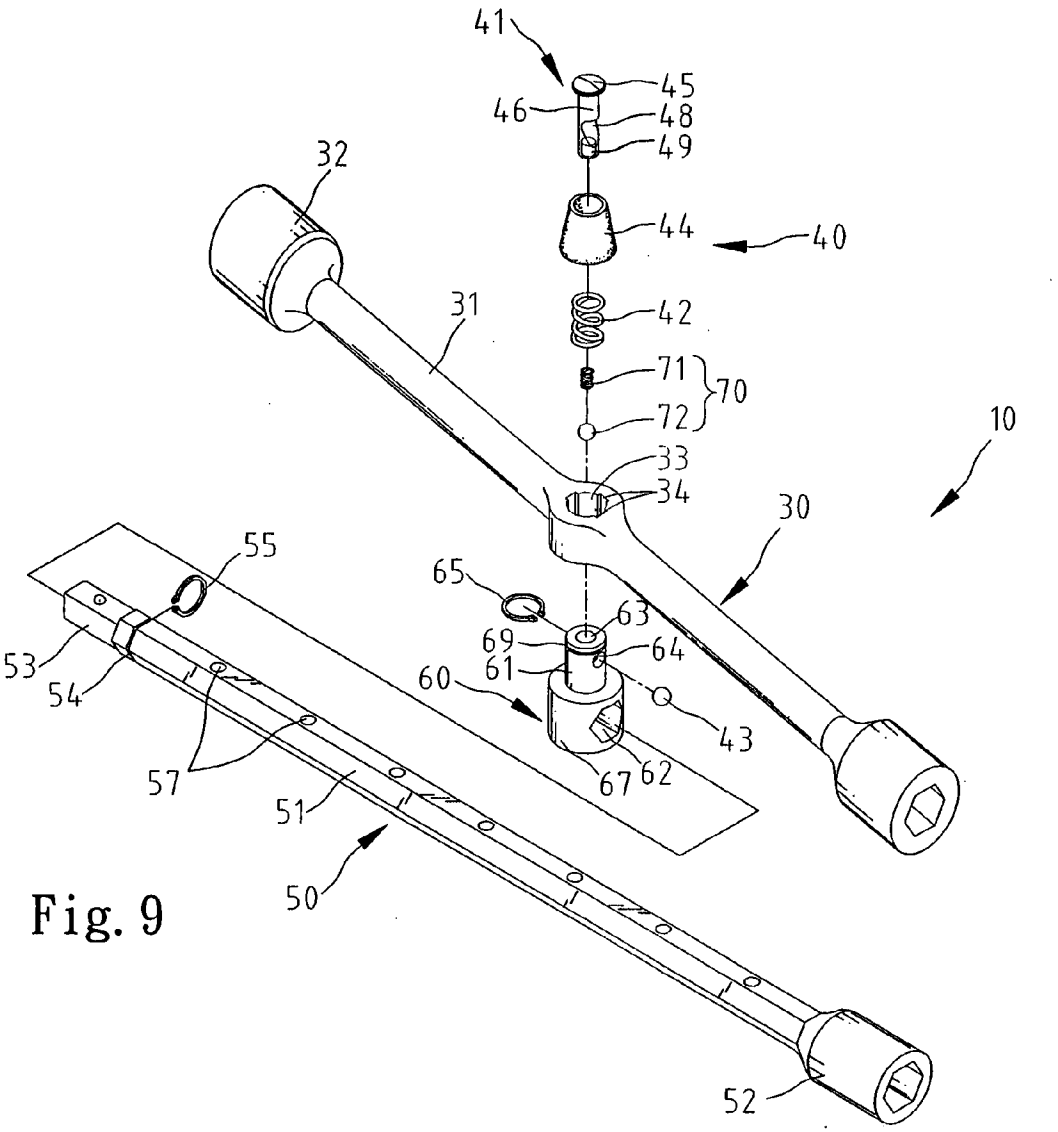
FIG. 9 is an exploded view of the wrench combination of FIG. 8.

FIGS. 8 and 9 show a wrench combination 10 according to a third embodiment of the present invention. The third embodiment is identical to the first embodiment except for several things. Firstly, the first wrench 50 includes a shaft 51, a socket 52 formed at an end of the shaft 51, a square insert 53 extending from the other end of the shaft 51 and an annular groove 54 defined in the shaft 51 near the square insert 53. The square insert 53 is used for insertion into a square hole defined in a socket (not shown). The shaft 51 includes many facets. A group of recesses 57 is defined in one of the facets of the shaft 51. Secondly, a connecting element 60 includes a tube 61 and a ring 67 from which the tube 61 projects. The tube 61 includes a bore 63, an aperture 64 communicated with the bore 63 and an annular groove 69 defined in the periphery thereof. The ring 67 includes an aperture 62 communicated with the bore 63. The aperture 62 is used for receiving the first wrench 50 because it shaped like a hexagon. A C-ring 55 includes an internal edge put in the annular groove 54 so that the first wrench 50 will not fall from the connecting element 60 when it moves in the aperture 62. A C-ring 65 includes an internal edge put in the annular groove 69 so that the second wrench 30 is firmly attached to the connecting element 60. Thirdly, a positioning device 70 includes a spring 71 and a ball detent 72. Fourthly, the control element 41 includes a recess 49 defined in the shaft 46. The recess 49 is used for receiving the spring 71 and a portion of the ball detent 72.

Figure 10:
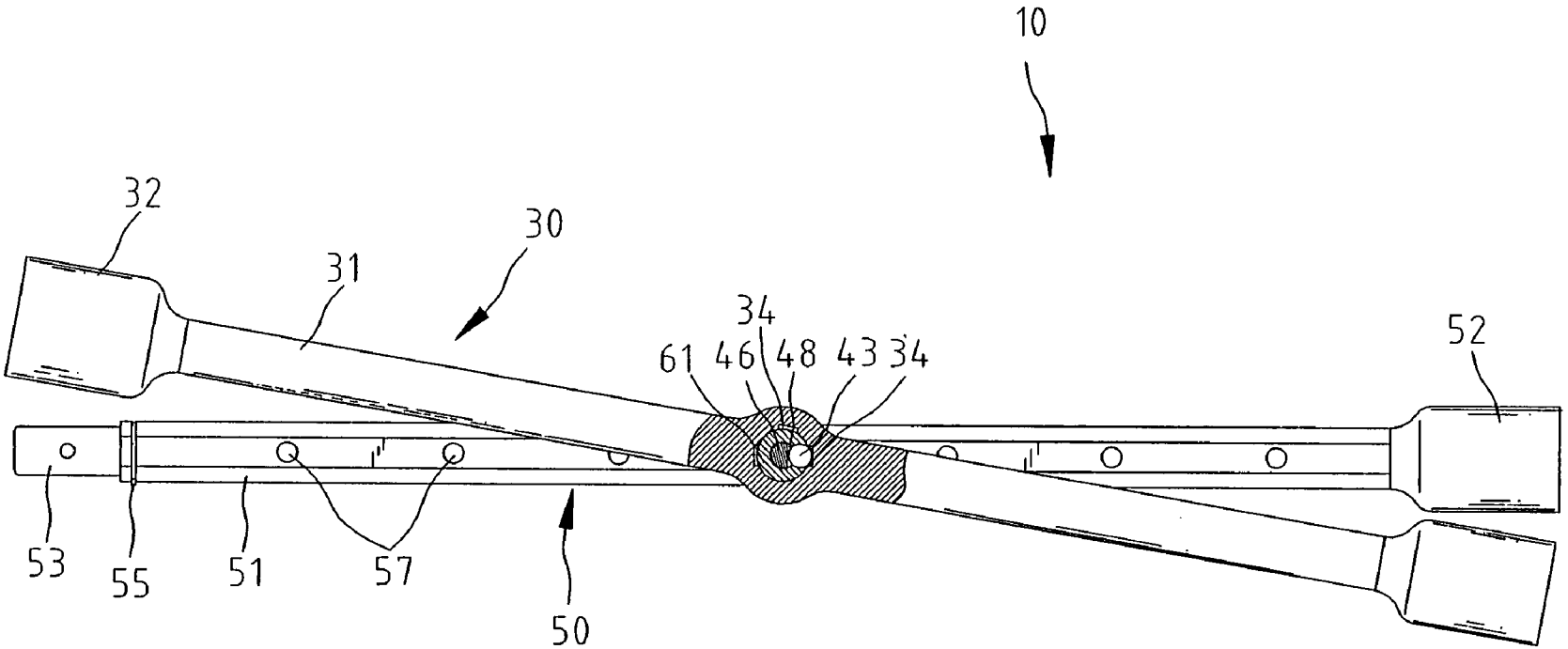
FIG. 10 is a partially cross-sectional view of the wrench combination of FIG. 8 and shows the wrenches in a locked mode.

Referring to FIG. 10, the wrench combination 10 is closed. The ball detent 43 is inserted into one of the grooves 34 by means of the recess 48. Therefore, the ball detent 43 can retain the first wrench 50 in position relative to the second wrench 30.

Figure 11:
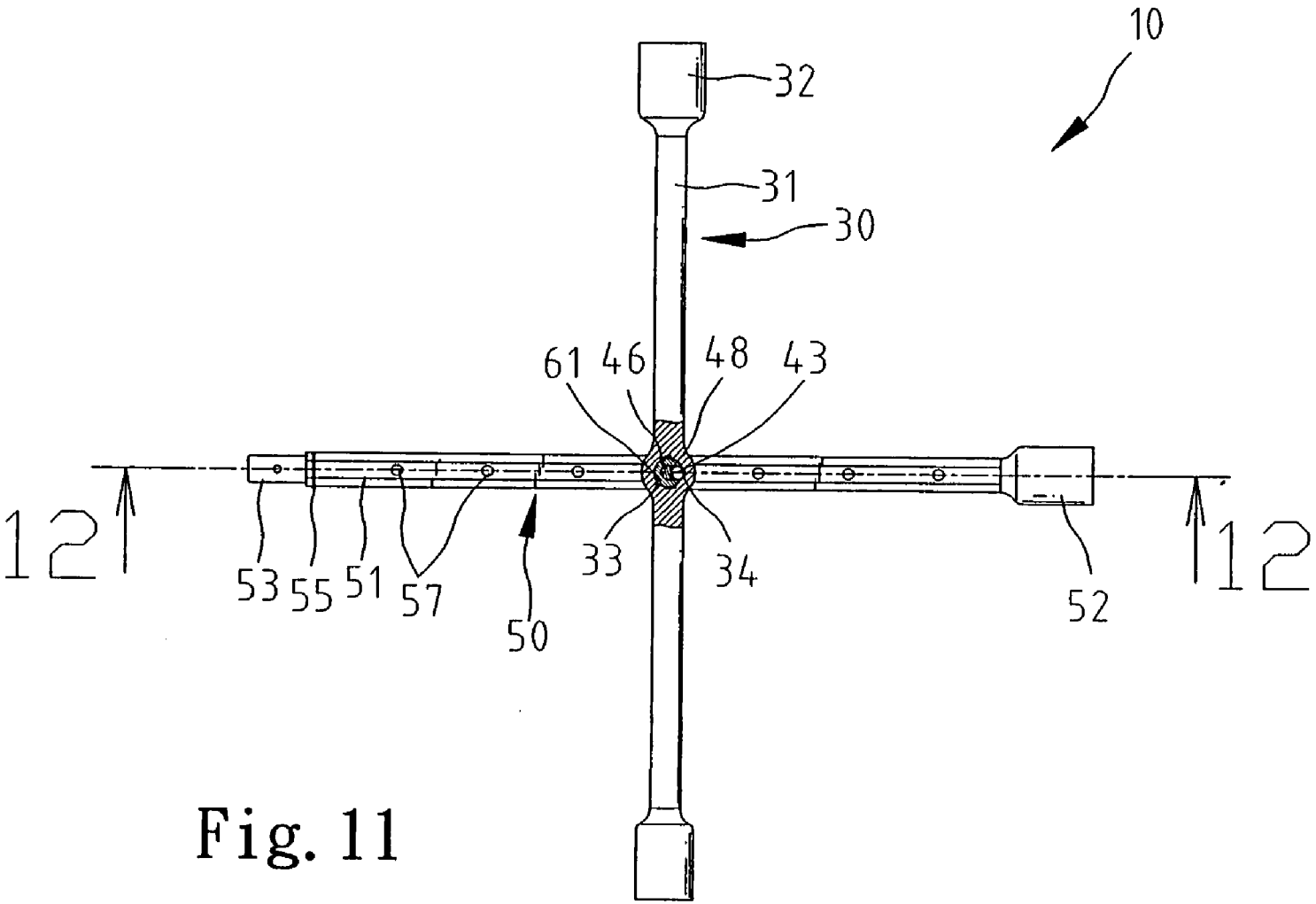
FIG. 11 is similar to FIG. 10 but shows the wrenches in a intersectional position.

FIG. 11 is similar to FIG. 10 but shows the first wrench 50 and the second wrench 30 at an intersectional position. The ball detent 43 is inserted into another one of the grooves 34.

Figure 12:
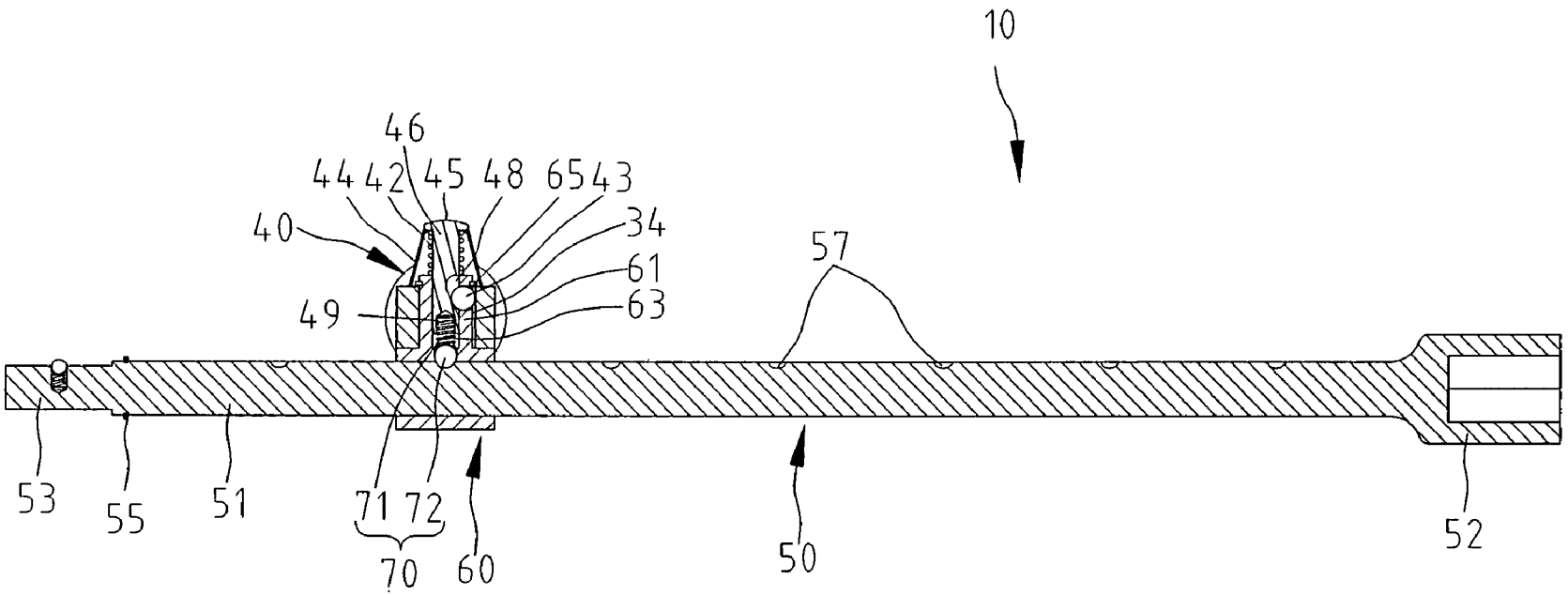
FIG. 12 is a cross-sectional view taken along a line 12—12 of FIG. 11.
Figure 13:
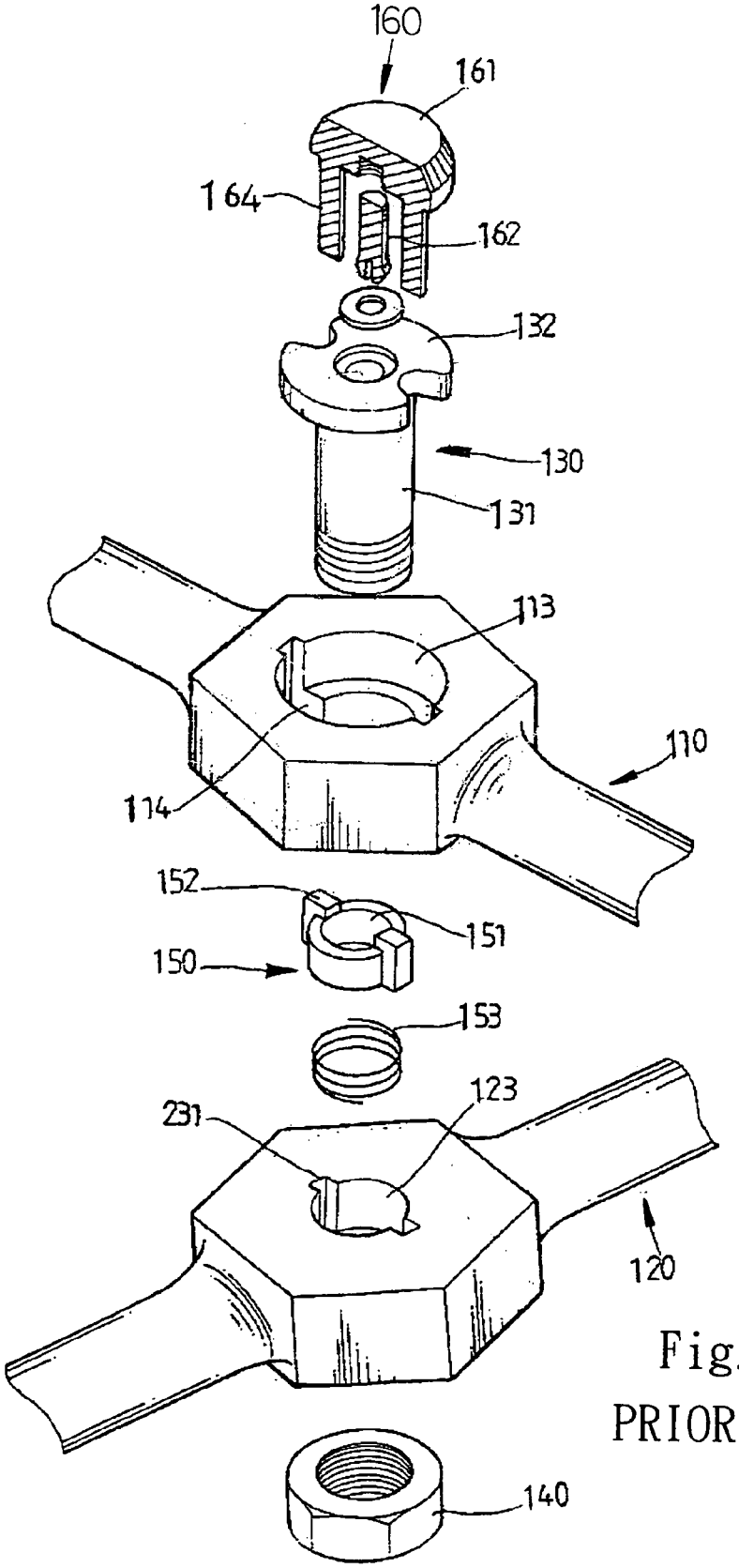
Fig. 13 PRIOR ART
FIG. 13 is an exploded view of a conventional wrench combination.

FIG. 12 shows the ball detent 72 put in one of the recesses 57 so as to keep the first wrench 50 in position relative to the connecting element 60, and the ball detent 43 is caused to extend into one of the grooves 34 so as to keep the second wrench 30 in position relative to the connecting element 60.

The present invention has been described through detailed illustration of three embodiments. Those skilled in the art can derive variation from the embodiments without departing from the scope of the present invention. Therefore, the embodiments shall not limit the scope of the present invention defined in the claims.

What is claimed is:

1. A wrench combination comprising:

a first wrench comprising a shaft and at least one socket at an end of the shaft; and a second wrench rotationally connected with the first wrench, the second wrench comprising a shaft and two sockets each formed at an end of the shaft wherein the first wrench comprises a tube formed thereon, wherein the second wrench comprises a bore defined therein, wherein the bore is used for receiving the tube.

2. The wrench combination according to claim 1 comprising a C-ring, wherein the tube defines an annular groove in an external side for receiving an internal edge of the C-ring.

3. The wrench combination according to claim 1 comprising a detent, wherein the second wrench comprises at least one groove communicated with the bore for receiving the detent so as to keep the first wrench in position relative to the second wrench.

4. The wrench combination according to claim 3 wherein the bore comprises three grooves for receiving the detent so as to keep the first wrench in position relative to the second wrench.

5. The wrench combination according to claim 3 comprising a control device for controlling the movement of the detent.

6. The wrench combination according to claim 5 wherein the control device comprises a control element, and the tube comprises a bore defined therein and an aperture communicated with the bore so that the control element is moveable in the bore for pushing the detent from the aperture.

7. The wrench combination according to claim 6 wherein the control element comprises a head and a rod extending from the head into the bore defined in the tube.

8. The wrench combination according to claim 7 wherein the rod of the control element comprises a recess for receiving the detent.

9. The wrench combination according to claim 6 wherein the control device includes a spring compressed between a portion of the control element and a portion of the tube.

10. The wrench combination according to claim 6 wherein the control device includes a cap put outside the control element and the spring, the cap prevents the dust or oil sludge from entering the wrench combination.

11. A wrench combination comprising:

a first wrench comprising a shaft, at least one socket formed at an end of the shaft and a second wrench comprising a shaft and at least one socket each formed at an end of the shaft; and a connecting element for rotationally connecting the first wrench with the second wrench wherein the connecting element for rotationally connecting the first wrench with the second wrench comprises a ring, for receiving the first wrench and a tube extending from the ring, wherein the second wrench comprises a bore for receiving the tube of the connecting element.

12. The wrench combination according to claim 11 comprising a detent attached to the connecting element, wherein the shaft defines at least one recess for receiving the detent so as to keep the first wrench in position relative to the connecting element.

13. The wrench combination according to claim 12 wherein the shaft defines a series of recesses.

14. The wrench combination according to claim 11 comprising a C-ring, wherein the shaft defines an annular groove in an external side for receiving an internal edge of the C-ring.

15. The wrench combination according to claim 11 comprising a detent, wherein the second wrench comprises at least one groove communicated with the bore for receiving the detent so as to keep the second wrench in position relative to the connecting element.

16. The wrench combination according to claim 15 comprising a control device for controlling the movement of the detent.

17. The wrench combination according to claim 16 wherein the control device comprises an control element, wherein the tube comprises a bore for receiving the control element and an aperture communicated with the bore so that the control element is movable in the bore for pushing the detent into the groove through the aperture.

18. The wrench combination according to claim 11 comprising a C-ring, wherein the tube defines an annular groove in an external side for receiving an internal edge of the C-ring.

* * * * *